US009808681B2

(12) United States Patent
Takechi

(10) Patent No.: US 9,808,681 B2
(45) Date of Patent: Nov. 7, 2017

(54) GOLF CLUB HEAD

(71) Applicant: Bridgestone Sports Co., Ltd., Tokyo (JP)

(72) Inventor: Takaharu Takechi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 15/153,381

(22) Filed: May 12, 2016

(65) Prior Publication Data

US 2016/0346645 A1 Dec. 1, 2016

(30) Foreign Application Priority Data

May 25, 2015 (JP) ..... 2015-105628
May 25, 2015 (JP) ..... 2015-105629

(51) Int. Cl.
*A63B 53/04* (2015.01)
*A63B 60/50* (2015.01)

(52) U.S. Cl.
CPC ..... *A63B 53/0466* (2013.01); *A63B 60/50* (2015.10); *A63B 2053/0408* (2013.01); *A63B 2053/0437* (2013.01); *A63B 2053/0462* (2013.01)

(58) Field of Classification Search
CPC ..... A63B 53/04; A63B 53/0466
See application file for complete search history.

(56) References Cited

U.S. PATENT DOCUMENTS 5,421,577 A * 6/1995 Kobayashi ..... A63B 53/04 473/334
5,766,094 A * 6/1998 Mahaffey ..... A63B 53/04 473/342
5,830,084 A 11/1998 Kosmatka
2013/0072321 A1 3/2013 Morales et al.
2013/0324308 A1* 12/2013 Boyd ..... A63B 53/0466 473/346
2014/0057737 A1* 2/2014 Solheim ..... A63B 53/0466 473/345
2015/0238827 A1* 8/2015 Nakamura ..... A63B 53/0466 473/345

FOREIGN PATENT DOCUMENTS

JP 2002-045445 A 2/2002
JP 2005-137788 A 6/2005
JP 2006-181189 A 7/2006
JP 2007-151758 A 6/2007
JP 5009525 B2 8/2012
JP 2013-000234 A 1/2013
JP 2013-240404 A 12/2013
JP 2014-526366 A 10/2014

* cited by examiner

*Primary Examiner* — Michael Dennis
(74) *Attorney, Agent, or Firm* — Muncy, Geissler, Olds & Lowe, P.C.

(57) ABSTRACT

A hollow golf club head comprises a face part, a sole part, a side part, a crown part, and a hosel part. At least one of the face part and the crown part has portions of two different rigidities that are first and second rigid portions, the first rigid portion has a first rigidity, the second rigid portion is made of the same material as the first rigid portion, and the second rigid portion has the same thickness as the first rigid portion but has a lower rigidity than the first rigidity of the first rigid portion.

12 Claims, 12 Drawing Sheets

GOLF CLUB HEAD

CROSS REFERENCE TO RELATED APPLICATIONS

This application claims priorities under 35 USC 119 to Japanese Patent Application No. 2015-105628 filed on May 25, 2015 and to Japanese Patent Application No. 2015-105629 filed on May 25, 2015, the entire contents which are incorporated herein by reference.

TECHNICAL FIELD

The present invention relates to a golf club head and, more specifically, to a hollow golf club head.

BACKGROUND

The head of a wood-type golf club such as a driver or a fairway wood is often hollow and made of metal. A hollow wood-type golf club head has a face part for striking the ball, a crown part comprising the upper surface part of the golf club head, a sole part comprising the bottom surface part of the golf club head, a side part comprising the side surface part on the back side and the heel side, and a hosel part. A shaft is inserted into the hosel part and secured using an adhesive. Recently, a golf club known as a utility club has become widely available. One type of utility golf club that has become widely available is a golf club with a hollow head resembling that of a wood-type golf club head (that is, having a face part, a sole part, a side part, a crown part, and a hosel part).

Aluminum alloys, stainless steel, and titanium alloys are used as the metal constituting the hollow golf club head, but titanium alloys have become more widely used in recent years.

RELATED ART

As described in Patent Documents 1 and 2, the thickness of the central portion of the face part is known to be greater than that of the peripheral portion.

Patent Document 3 describes a golf club head having a plurality of cells in the face plate.

Patent Documents 4 and 5 describe a simulation analysis of stress on a golf club head using the finite element method.

As described in Patent Documents 6 through 8, reducing the rigidity of the crown part increases the rigidity of the sole part of a hollow golf club head, the relative deflection of the crown part when a golf ball is struck, and the launch angle of the golf ball.

In order to reduce the rigidity of the crown portion, a thin, low-rigidity region and a thick, high-rigidity region are provided in the crown part of a hollow golf club head as described in Patent Document 6. A hollow golf club head in which a first thin portion and a second thin portion have been provided in the crown part is described in Patent Document 7. A hollow golf club head in which rigidity is reduced by providing a thin portion closer to the rear portion than to the front portion of the crown part is described in Patent Document 8.

PRIOR ART DOCUMENTS

[Patent Document 1] JP2002-45445A
[Patent Document 2] JP2013-234A
[Patent Document 3] JP2014-526366A

[Patent Document 4] JP2006-181189A
[Patent Document 5] U.S. Pat. No. 5,009,525
[Patent Document 6] JP2007-151758A
[Patent Document 7] JP2013-240404A
[Patent Document 8] JP2005-137788A

OBJECTS OF THE INVENTION

A first object of the present invention is to provide a golf club head in which a low-rigidity portion can be provided at the desired location in the face part.

A second object of the present invention is to provide a golf club head enabling the entire face part to have the same rigidity and the coefficient of restitution to be constant over the entire face part.

A third object of the present invention is to provide a golf club head in which a low-rigidity portion can be provided in the crown part to increase the relative deflection of the crown part when a golf ball is struck and to increase the launch angle of the golf ball.

A fourth object of the present invention is to provide a golf club head in which the minimum required strength can be imparted to the crown part.

SUMMARY

A hollow golf club head of the invention comprises a face part, a sole part, a side part, a crown part, and a hosel part, wherein at least one of the face part and the crown part has portions of two different rigidities that are first and second rigid portions, the first rigid portion has a first rigidity, the second rigid portion is made of the same material as the first rigid portion, and the second rigid portion has the same thickness as the first rigid portion but has a lower rigidity than the first rigidity of the first rigid portion.

In one embodiment of the invention, the one of the face part and the crown part having the first and second rigid portions is press-worked.

In one embodiment of the invention, the one of the face part and the crown part having the first and second rigid portions is formed with a single seamless member.

In one embodiment of the invention, the golf club head is formed with a single seamless member.

In one embodiment of the invention, the second rigid portion has a porous form.

In one embodiment of the invention, the second rigid portion has a hollow form.

In one embodiment of the invention, the second rigid portion has a rigidity that is ranged from 60% to 90% of the first rigid portion.

In another invention, a hollow golf club head comprises a face part, a sole part, a side part, a crown part, and a hosel part, wherein at least one of the face part and the crown part has portions of two different thicknesses that are first and second thickness portions, the first thickness portion having a first thickness, and the second thickness portion having a second thickness that is different from the first thickness, and a rigidity of the first thickness portion is the same as a rigidity of the second thickness portion.

In one embodiment of the another invention, the one of the face part and the crown part having the first and second thickness portions has a uniform rigidity through the entirety thereof.

In the invention, the same rigidities mean that they are substantially the same. They do not necessarily mean exactly the same value. For example, where one portion has rigidity K1 and another portion has rigidity K2 and a rigidity differential value, which is (K1−K2), is 10% or less than an average rigidity value, which is (K1+K2)/2, rigidities K1 and K2 are regarded as the same. With respect to the thickness, the same thickness is regarded in the same fashion. For example, where one portion has thickness T1 and another portion has thickness T2 and a thickness differential value, which is (T1−T2), is 10% or less than an average thickness value, which is (T1+T2)/2, thicknesses K1 and K2 are regarded as the same.

In a golf club head according to a first aspect of the present invention, a second rigid portion of the face part is identical to a first rigid portion in terms of material and thickness but has a lower rigidity. As a result, the low-rigidity portion can be arranged at the desired location in the design process.

In a golf club head according to a second aspect of the present invention, a first thickness portion and a second thickness portion of the face part have the same rigidity. As a result, the entire face part has the same rigidity and the coefficient of restitution is constant over the entire face part.

In a golf club head according to a third aspect of the present invention, a second rigid portion of the crown part is identical to a first rigid portion in terms of material and thickness but has a lower rigidity. As a result, the relative deflection of the crown part is increased when a golf ball is struck, and the launch angle of the golf ball is increased.

In a golf club head according to a fourth aspect of the present invention, a first thickness portion and a second thickness portion of the crown part have the same rigidity. As a result, the minimum required strength can be imparted to the first thickness portion and the second thickness portion.

DETAILED DESCRIPTION OF THE EMBODIMENTS

The following is an explanation of a golf club head in an embodiment of the present invention with reference to the drawings. In the present invention, high-rigidity portions are denoted by Hx and low-rigidity portions are denoted by Lx (where x is an arbitrary number).

Figure 1A:
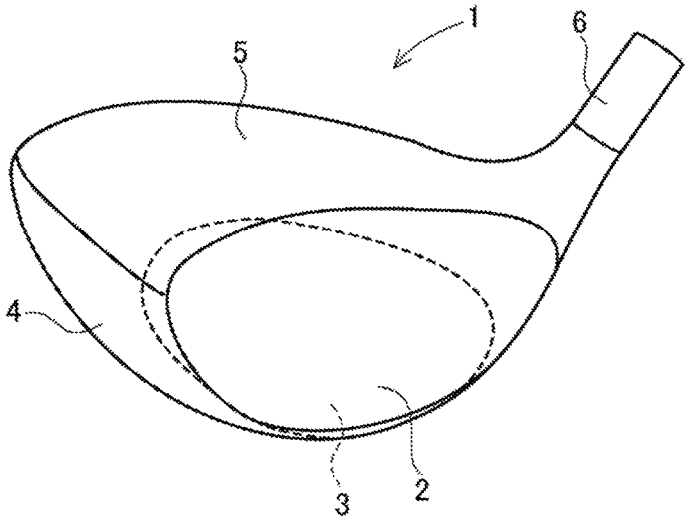
FIG. 1A is a perspective view of the golf club head in a first embodiment of the present invention.
Figure 1B:
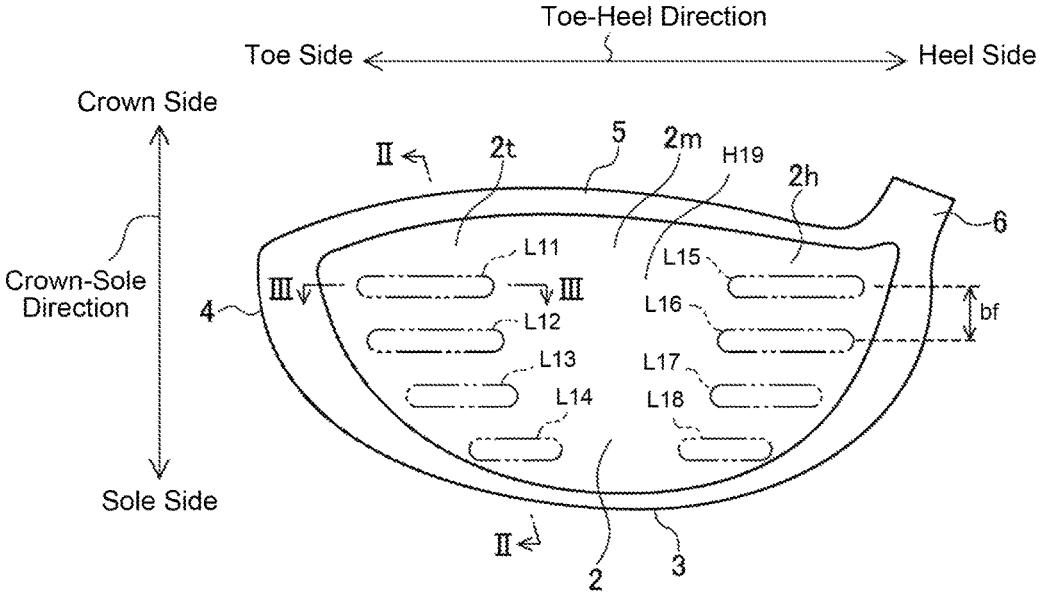
FIG. 1B is a front view of the same.
Figure 2:
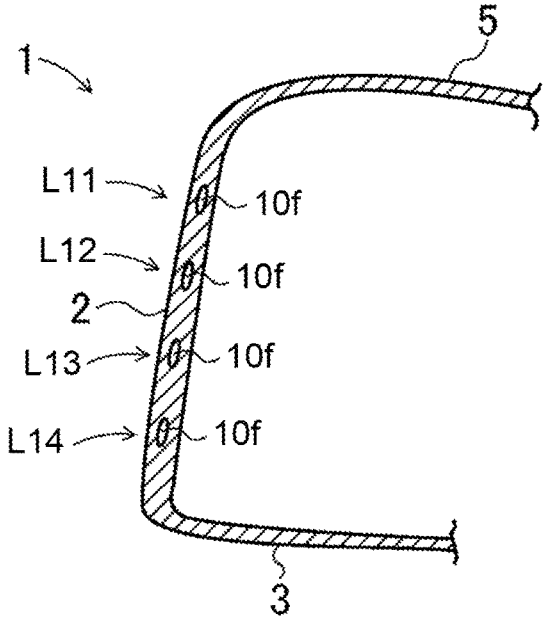
FIG. 2 is a sectional view from line II-II in FIG. 1B.
Figure 3:
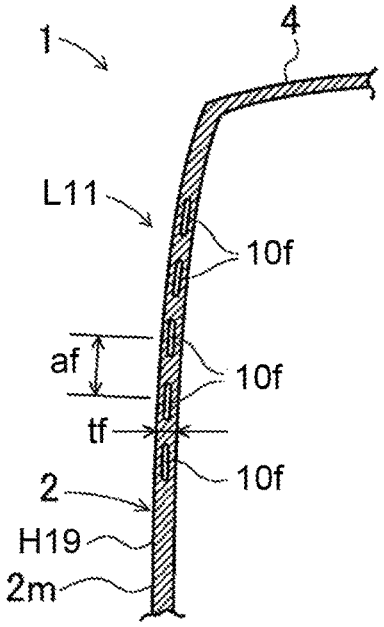
FIG. 3 is a sectional view from line in FIG. 1B.

The golf club head 1 shown in FIG. 1 through FIG. 3 is a hollow driver head having a face part 2, a sole part 3, a side part 4, a crown part 5, and a hosel part 6. The golf club head 1 is integrally made of metal. Examples of metals include titanium, titanium alloys, aluminum alloys, and stainless steel, but a titanium alloy is preferred. A part of the golf club head 1, for example, the sole part or the side part, may be provided with a decorative element or name plate made of, for example, a synthetic resin, rubber, or elastomer.

The face part 2 is the surface which strikes the ball. The sole part 3 comprises the bottom surface part of the golf club head, and the crown part 5 comprises the upper surface part of the golf club head. The side part 4 comes into contact with the sole part 3 and the crown part 5, and extends from the toe side to the heel side via the back side. The shaft is secured to the hosel part 6.

In the present embodiment, low-rigidity portions (second rigidity portions) L11-L14 and L15-L18 are provided, respectively, on the toe side 2*t* and the heel side 2*h* of the face part 2. A high-rigidity portion (first rigidity portion) H19 is provided in addition to the low-rigidity portions L11-L18.

The thickness tf of the face part 2 is the same in the low-rigidity portions L11-L18 and the high-rigidity portion H19. The central portion 2*m* of the face part 2 also has a thickness equal to that of the toe side 2*t* and the heel side 2*h*.

The entire face part 2 is made of the same material (for example, a titanium alloy). The thickness of the low-rigidity portions L11-L18 and the high-rigidity portion H19 is the same, but the rigidity is reduced relative to the high-rigidity portion H19 by the presence of hollow chamber parts 10*f*. Preferably, the rigidity of the low-rigidity portions L11-L18 is from 60 to 90%, particularly from 65 to 85%, of the rigidity of the high-rigidity portion H19.

In the present embodiment, the hollow chamber parts 10*f* have a flat disk-like shape. Preferably, the diameter of the hollow chamber parts 10*f* when the face part 2 is viewed from the front is 0.5 mm or more, particularly 1 mm or more, and 10 mm or less, particularly 5 mm or less. Preferably, the thickness of the hollow chamber parts 10*f*, that is, the dimension in the thickness tf direction of the face part 2 is 10% or more, particularly 20% or more, and 50% or less, particularly 30% or less of the thickness tf of the face part 2.

The low-rigidity portions L11-L18 are formed by arranging a plurality of hollow chamber parts 10*f* at intervals in the toe-heel direction. Preferably, the arrangement pitch of between hollow chamber parts 10*f*, 10*f* in the toe-heel direction is 0.5 mm or more, particularly 1 mm or more, and 30 mm or less, particularly 10 mm or less.

In the present embodiment, low-rigidity portions L11-L14 and L15-L18 are each arranged in four rows. However, they may be arranged in three or fewer rows or in five or more rows. When the low-rigidity portions are provided in a plurality of rows, the preferred arrangement pitch bf between low-rigidity portions in the crown-sole direction is 1 mm or more, particularly 3 mm or more, and 20 mm or less, particularly 30 mm or less. Low-rigidity portions may be similarly provided in the crown part as well.

Preferably, the length of the low-rigidity portions L11-L18 in the toe-heel direction is 3 mm or more, particularly 5 mm or more, and 30 mm or less, particularly 20 mm or less.

Figure 4:
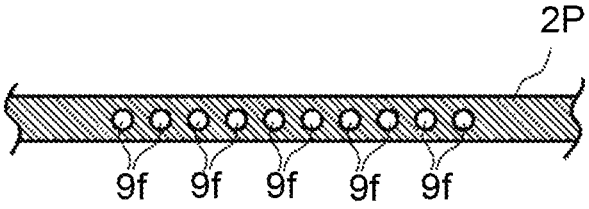
FIG. 4 is a sectional view of the plate for the face part prior to press working.
Figure 5:
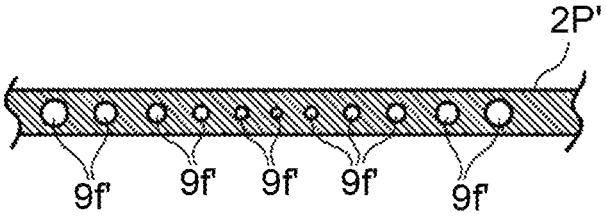
FIG. 5 is a sectional view of the plate for the face part prior to press working.

As shown in FIG. 4 and FIG. 5, the hollow chamber parts 10*f* are formed by press-working (including rolling and forging) face plate 2P or 2P' having holes 9*f* or 9*f'* of a given shape. The holes 9*f* in face plate 2P have a uniform diameter, whereas the holes 9*f'* in face plate 2P' have a distribution of large and small diameters. When face plate 2P is press-worked, the hollow chamber parts 10*f* are of uniform size. When face plate 2P' is press-worked, the hollow chamber parts 10*f* have distribution of large and small sizes. Thinning occurs during press-working, but the strength of the solid portion (high-rigidity portion H19) is actually increased by work hardening. Because the thickness can be reduced while increasing strength, the weight can be effectively reduced.

In a golf club head 1 with this configuration, the entire face part 2 has a uniform thickness, and low-rigidity portions L11-L18 are provided in the toe side 2*t* and the heel side 2*h* of the face part 2. As a result, deflection of the toe side 2*t* and the heel side 2*h* of the face part 2 is increased when a golf ball is struck. When a golf ball is struck with this golf club head 1, the initial velocity of the golf ball is increased and the flight distance of the ball is lengthened.

In the present embodiment, the shape, size, and distribution of hollow chamber parts 10*f* can be established by forming holes 9*f*, 9*f'* of a certain shape and size in the face plates 2P, 2P'. As a result, golf club heads with the desired degree of deflection on the toe side 2*t* and heel side 2*h* of the face part 2 can be readily manufactured.

In the present embodiment, all of the low-rigidity portions L11-L18 extend in the toe-heel direction, but they may extend in another direction. Examples are shown in FIG. 6 through FIG. 9.

Figure 6:
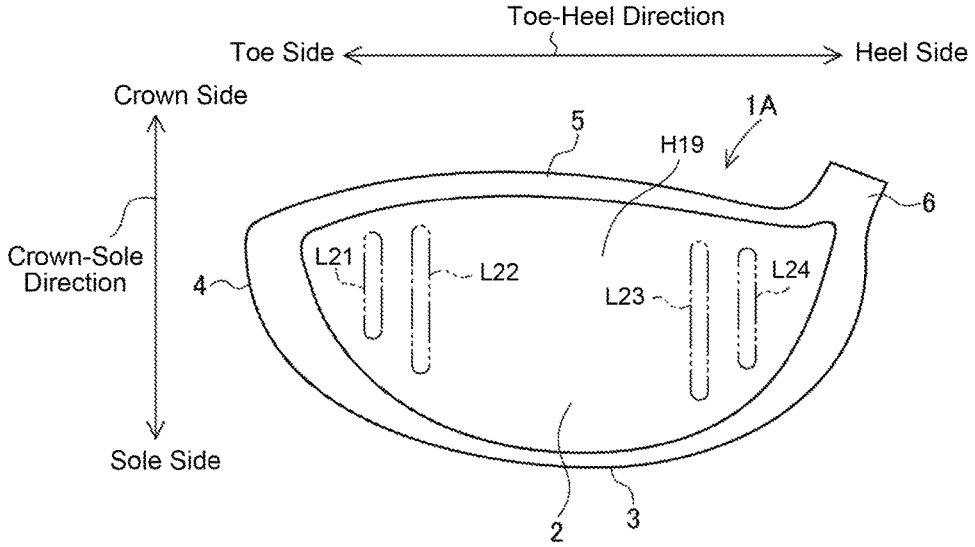
FIG. 6 is a front view of the golf club head in the first embodiment of the present invention.

In the golf club head 1A in FIG. 6, low-rigidity portions L21, L22 extending in the crown-sole direction are arranged on the toe side of the face part 2. Also, low-rigidity portions L23, L24 extending in the crown-sole direction are arranged on the heel side of the face part 2. While not shown in the drawing, the direction in which the low-rigidity portions L21-L24 extend may be an oblique direction relative to the crown-sole direction. Note that there are two of each low-rigidity portion L21-L24 on the toe side and the heel side in the drawing, but that there may be one or three or more. The entire face part 2 has the same thickness.

Figure 7:
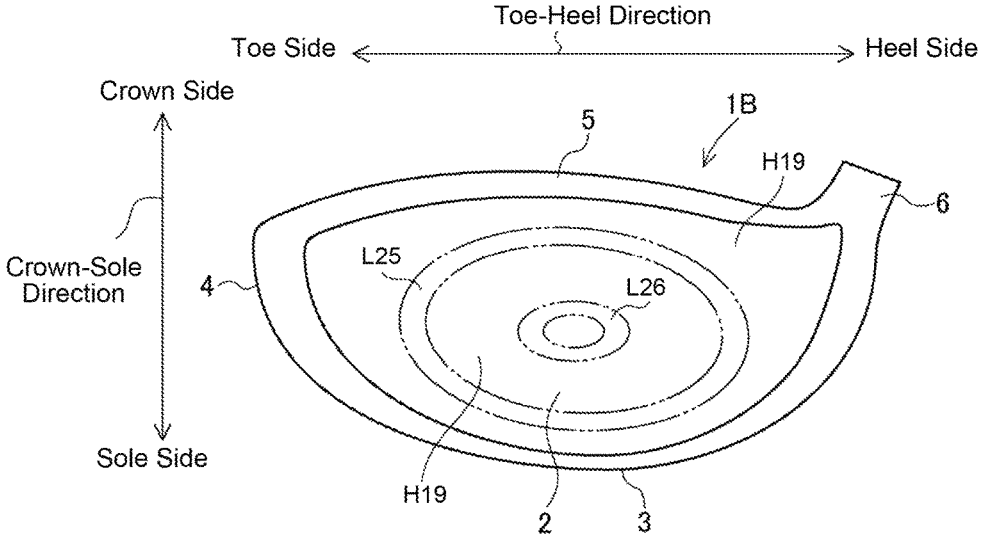
FIG. 7 is a front view of the golf club head in the first embodiment of the present invention.

In the golf club head 1B in FIG. 7, concentric, oval-shaped low-rigidity portions L25, L26 are provided with the long axis in the toe-heel direction. The center of each concentric oval is near the center of the face part 2 in the toe-heel direction and in the face-back direction. The number of low-rigidity portions L25, L26 may be one or three or more. The entire face part 2 has the same thickness.

The configuration of the golf club heads 1A, 1B with the exception of the face part 2 is the same as that of golf club head 1 and identical components are denoted by the same reference numbers.

Figure 8:
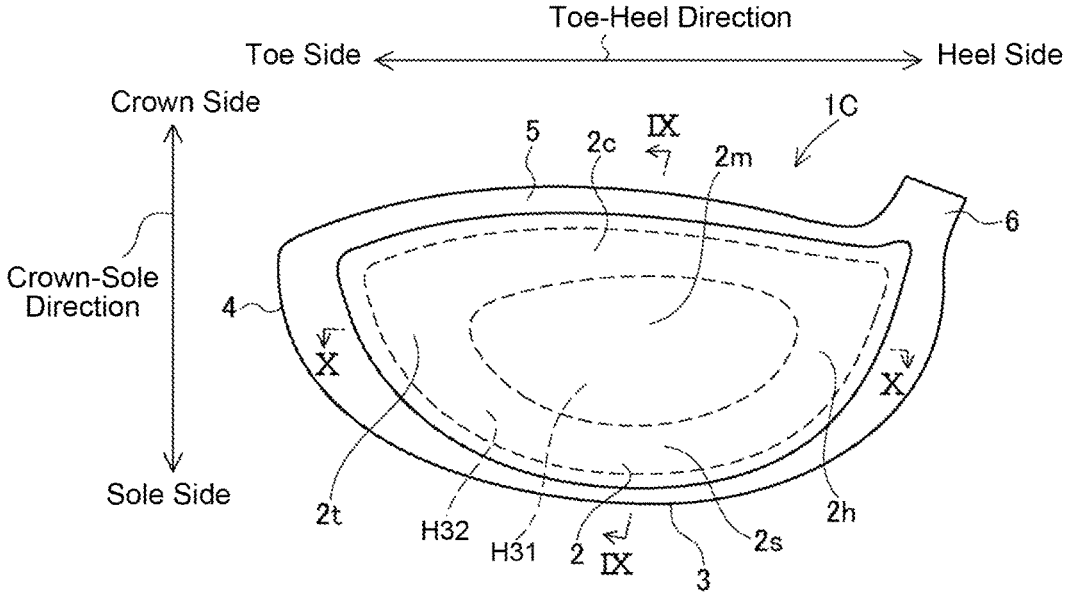
FIG. 8 is a front view of the golf club head in the second embodiment of the present invention.
Figure 9:
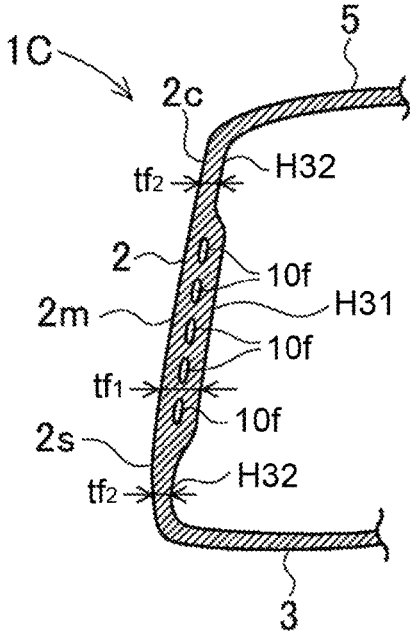
FIG. 9 is a sectional view from line IX-IX in FIG. 8.
Figure 10:
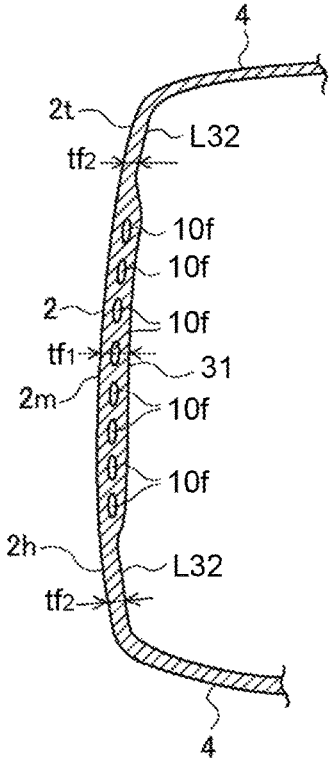
FIG. 10 is a sectional view from line X-X in FIG. 8.

FIG. 8 through FIG. 10 show the golf club head 1C in a second embodiment of the present invention which has a first thickness portion and a second thickness portion.

This golf club head 1C also has a face part 2, a sole part 3, a side part 4, a crown part 5, and a hosel part 6, and the entire head is integrally made of metal.

The face part 2 has a first thickness portion H31 with a greater thickness $tf_1$ and a second thickness portion L32 with a lesser thickness $tf_2$. In the present embodiment, the first thickness portion H31 occupies the center portion 2*m* of the face part 2. The second thickness portion L32 surrounds the first thickness portion H31 and extends over the toe side 2*t*, the crown side 2*c*, the heel side 2*h*, and the sole side 2*s*.

The first thickness portion H31 is provided so that the hollow chamber parts 10*f* have a substantially uniform distribution. In this way, the rigidities of the first thickness portion H31 and the second thickness portion H32 are substantially equal. The thickness $tf_2$ of the second thickness portion L32 is preferably from 50 to 80% of the thickness $tf_1$ of the first thickness portion H31.

The golf club head 1C can be designed so that the face part 2 has the minimum required strength. The minimum required strength of the golf club head 1C, particularly the face part 2, can be determined using the finite element method (FEM) disclosed in Patent Documents 4 and 5. In other words, FEM analysis can be used to design the head so that the portions subjected to low stress have low rigidity. In this way, the minimum required rigidity can be realized.

For example, in a model of the golf club head 1C without a hollow chamber part, the thickness is determined by FEM analysis and the difference in rigidity between the first thickness portion and the second thickness portion is determined from the shape (curve) of the face part. The hollow chamber parts 10*f* are then arranged in the first thickness portion H31 with the greater thickness so as to eliminate the difference in rigidity.

When the entire face part 2 has the same rigidity, the coefficient of restitution is constant over the entire face part 2. Also, the stress from striking a ball is simulated, and the hollow chamber parts 10*f* are arranged so that the face part 2 has the minimum required rigidity to withstand this stress.

At the very least, the face part 2 of the golf club heads 1-1C can be obtained by press-working a face plate 2P, 2P'. However, press-working may be omitted.

The face plate 2P, 2P' (or the face part 2 when no press working is performed) is preferably manufactured as a single seamless component using the metal powder molding method. In the metal powder molding method, metal powder is exposed to a high-energy beam such as an electron beam or laser beam to sinter the metal powder and create the desired three-dimensional shape.

In the present explanation, the hollow chamber parts 10*f* have a flat disk-like shape. However, the hollow chamber parts are not limited to this shape. A face plate or a face part can be molded with any number of hollow chamber parts of any shape or size using the metal powder molding method. Parts other than the face part can also be molded using the metal powder molding method. When press-working is not performed, the entire golf club head can be molded as an integrated unit using the metal powder molding method. In this way, a golf club head can be molded as a single seamless component.

The molded product obtained in a molding step using the metal powder molding method can then be subjected to heat treatment, surface grinding and polishing, painting, and plating to obtain the final golf club head.

One example of the present invention was explained above, but the present invention can have other configurations.

Figure 11:
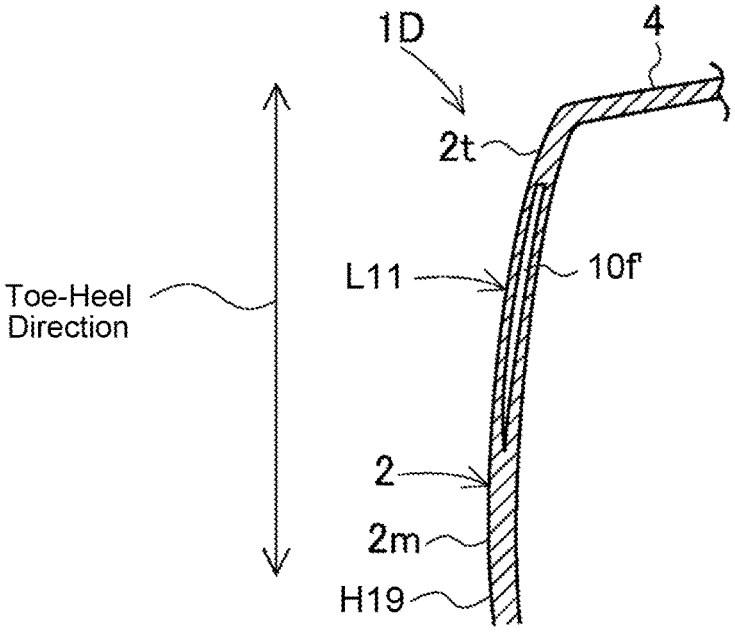
FIG. 11 is a sectional view of the golf club head in a variation of the first embodiment of the present invention.
Figure 12A:
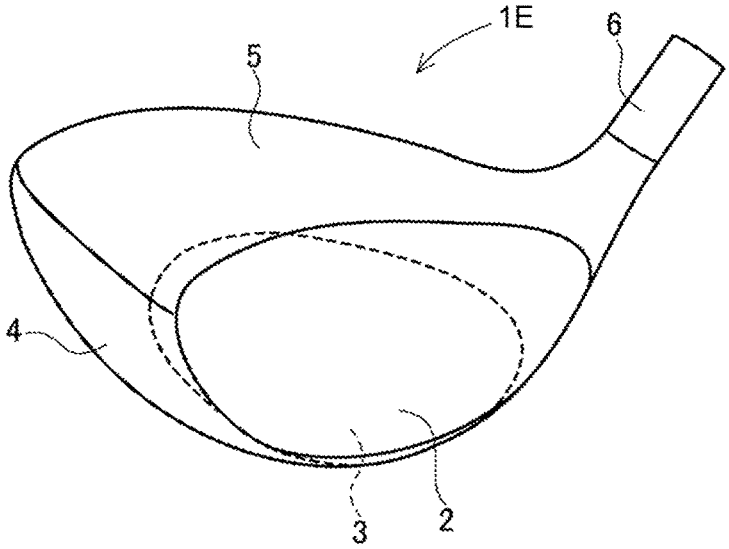
FIG. 12A is a perspective view of the golf club head in the first embodiment of the present invention.
Figure 12B:
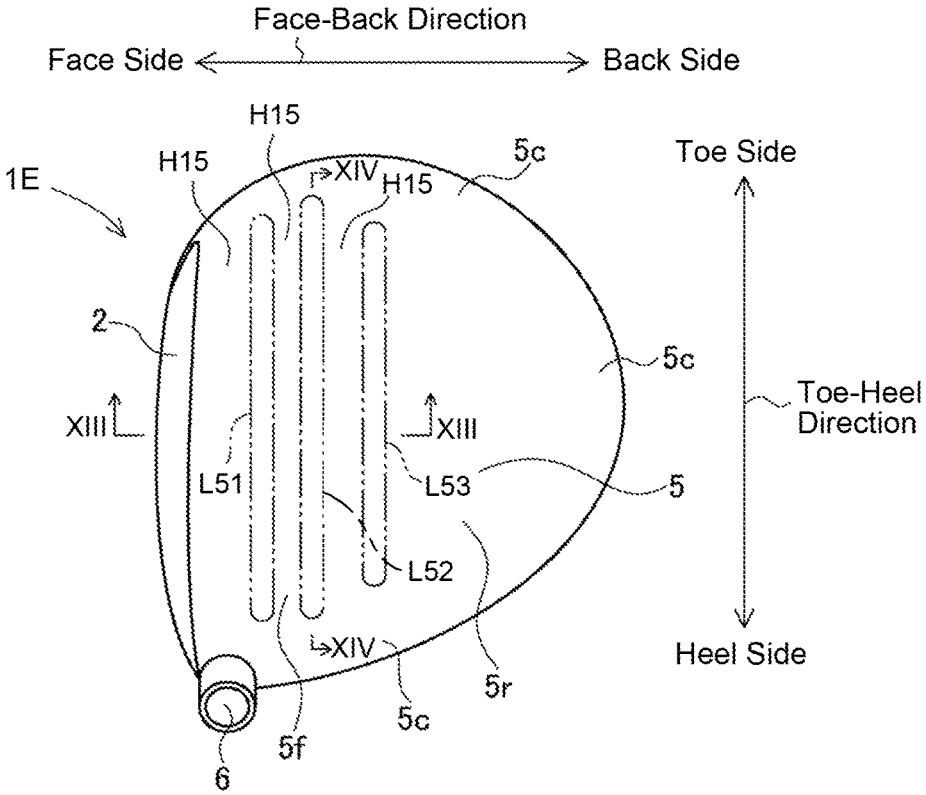
FIG. 12B is a plan view of the same.
Figure 13:
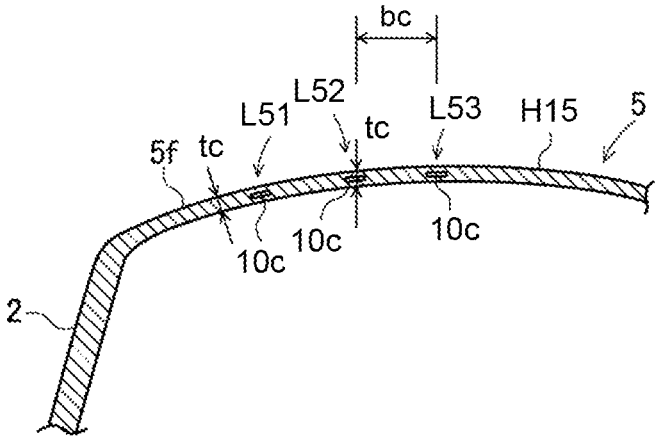
FIG. 13 is a sectional view from line XIII-XIII in FIG. 12B.
Figure 14:
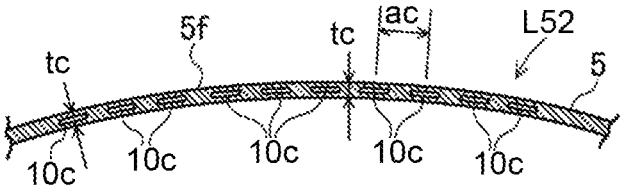
FIG. 14 is a sectional view from line XIV-XIV in FIG. 12B.

In the present invention, such as in golf club heads 1-1C, a plurality of very small hollow chamber parts 10*f* can be provided to partially reduce the rigidity of the face part. One or more large hollow chamber parts may also be provided to partially reduce the rigidity of the face part. FIG. 11 shows a golf club head 1D related to this example. This is a sectional view of the same components as those shown in FIG. 3. In this golf club head 1D, a single hollow chamber 10*f* is provided whose long axis is in the toe-heel direction in order to form a single low-rigidity portion L11. While not shown in the drawing, other low-rigidity portions L12-L18 are provided with the same configuration.

The present invention can also be applied to the head of a fairway wood other than a driver or to the head of a utility club.

The following is an explanation of a golf club head in another embodiment of the present invention with reference to the drawings.

The golf club head 1E shown in FIG. 12A through FIG. 14 is a hollow driver head having a face part 2, a sole part 3, a side part 4, a crown part 5, and a hosel part 6. The golf club head 1E is integrally made of metal. Examples of metals include titanium, titanium alloys, aluminum alloys, and stainless steel, but a titanium alloy is preferred. A part of the golf club head 1E, for example, the sole part or the side part, may be provided with a decorative element or name plate made of, for example, a synthetic resin, rubber, or elastomer.

The face part 2 is the surface which strikes the ball. The sole part 3 comprises the bottom surface part of the golf club head, and the crown part 5 comprises the upper surface part of the golf club head. The side part 4 comes into contact with the sole part 3 and the crown part 5, and extends from the toe side to the heel side via the back side. The shaft is secured to the hosel part 6.

In the present embodiment, the crown part 5 has a crown front portion 5*f* on the face side of the middle and a crown rear portion 5*r* on the back side of the middle in the face-back direction. Low-rigidity portions (second rigidity portions) L51, L52, and L53 are provided in the crown front portion 5*f*. The crown front portion 5*f* outside of the low-rigidity portions L51-L53 has a high-rigidity portion (first rigidity portion) H15.

The thickness tc of the crown front portion 5*f* is the same in the low-rigidity portions L51-L53 and the high-rigidity portion H15. The thickness of the rear crown portion 5*r* is the same as the thickness of the front crown portion 5*f* in the present embodiment, and the thickness tc of the entire crown portion is the same. However, at least some of the rear crown portion 5*r* has a different thickness from the front crown portion 5*f*. Also, the peripheral portion 5*c* of the crown part 5 on the toe side, back side, and heel side are different in thickness from the front crown portion 5*f*. For example, it can be thicker than the front crown portion 5*f*.

The entire crown part 5 is made of the same material (for example, a titanium alloy). The thickness of the low-rigidity portions L51-L53 is the same as the thickness of the high-rigidity portion H15, but the presence of hollow chamber parts 10*c* reduces their rigidity relative to the high-rigidity portion H15. Preferably, the rigidity of the low-rigidity portions L51-L53 is from 60 to 90%, particularly from 65 to 85%, of the rigidity of the high-rigidity portion H15.

In the present embodiment, the hollow chamber parts 10*c* have a flat disk-like shape. Preferably, the diameter of the hollow chamber parts 10*c* when the crown part 5 is viewed from the top (or crown-sole direction like in FIG. 12B) is 0.5 mm or more, particularly 1 mm or more, and 10 mm or less, particularly 5 mm or less. Preferably, the thickness of the hollow chamber parts 10*c*, that is, the dimension in the thickness tc direction of the crown part 5 is 10% or more, particularly 20% or more, and 50% or less, particularly 30% or less of the thickness tc of the front crown portion 5*f*.

The low-rigidity portions L51-L53 are formed by arranging a plurality of hollow chamber parts 10*c* at intervals in the toe-heel direction. Preferably, the arrangement pitch ac between hollow chamber parts 10*c*, 10*c* in the toe-heel direction is 1 mm or more, particularly 3 mm or more, and 20 mm or less, particularly 10 mm or less.

In the present embodiment, low-rigidity portions L51-L53 are arranged in a total of three rows. However, they may be arranged in one row, two rows, or four or more rows. When the low-rigidity portions are arranged in a plurality of rows, the preferred arrangement pitch be between low-rigidity portions in the face-back direction is 3 mm or more, particularly 5 mm or more, and 30 mm or less, particularly 20 mm or less. Low-rigidity portions may also be provided in the rear crown portion 5*r*.

The preferred interval between the low-rigidity portion L51 farthest on the face side and the edge portion of the crown part 5 on the face part 2 side is 1 mm or more, particularly 5 mm or more, and 30 mm or less, particularly 20 mm or less.

Figure 15:
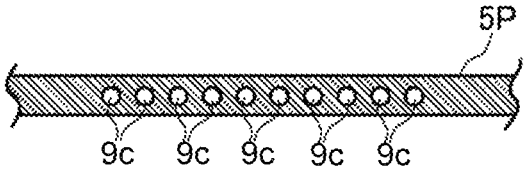
FIG. 15 is a sectional view of the plate for the crown part prior to press working.
Figure 16:
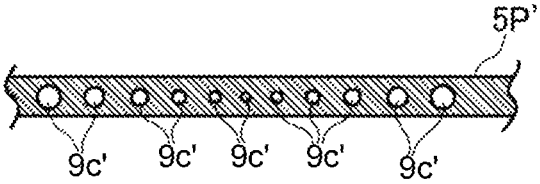
FIG. 16 is a sectional view of the plate for the crown part prior to press working.

As shown in FIG. 15 and FIG. 16, the hollow chamber parts 10*c* are formed by press-working (including rolling and forging) a crown plate 5P or 5P' having holes 9*c* or 9*c*' of a given shape. The holes 9*c* in crown plate 5P have a uniform diameter, whereas the holes 9*c*' in crown plate 5P' have a distribution of large and small diameters. When crown plate 5P is press-worked, the hollow chamber parts 10*c* are of uniform size. When crown plate 5P' is press-worked, the hollow chamber parts 10*c* have distribution of large and small sizes. Thinning occurs during press-working, but the strength of the solid portion (high-rigidity portion H15) is actually increased by work hardening. Because the thickness can be reduced while increasing strength, the weight can be effectively reduced.

In a golf club head 1E with this configuration, low-rigidity portions L51-L53 are provided in the crown part 5. As a result, deflection of the crown part 5 is increased when a golf ball is struck. When a golf ball is struck with this golf club head 1E, the launch angle of the golf ball is increased and the flight distance of the ball is lengthened.

In the present embodiment, the shape, size, and distribution of hollow chamber parts 10*c* can be established by forming holes 9*c*, 9*c*' of a certain shape and size in the crown plates 5P, 5P'. As a result, golf club heads with the desired degree of deflection in the crown part 5 can be readily manufactured.

In the present embodiment, all of the low-rigidity portions L51-L53 extend in the toe-heel direction, but they may extend in another direction. Examples are shown in FIG. 17 through FIG. 20.

Figure 17:
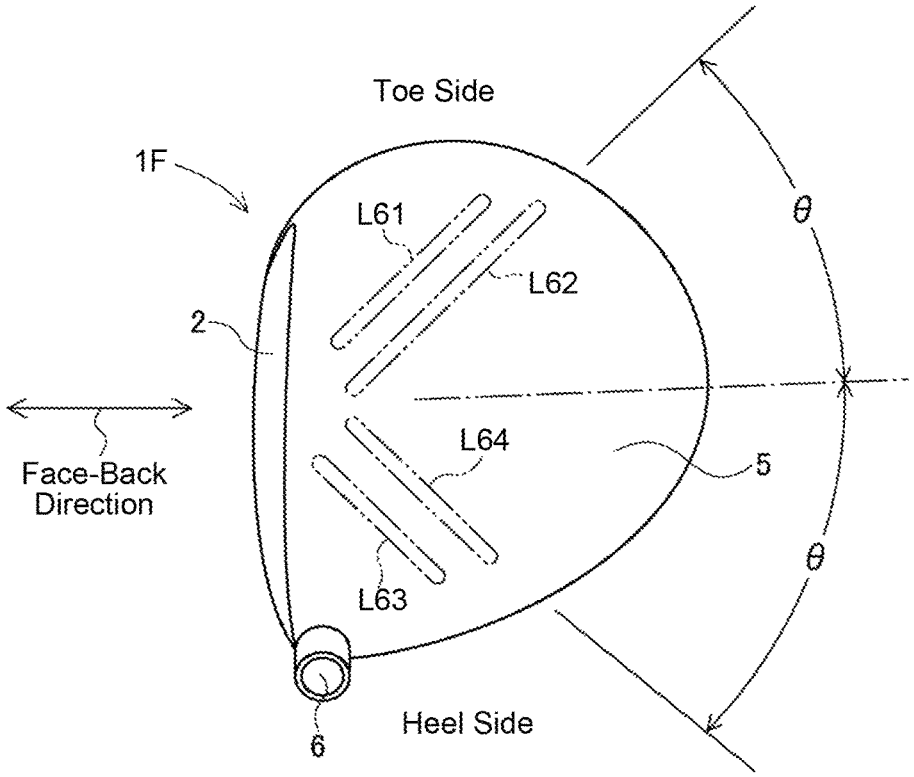
FIG. 17 is a plan view of the golf club head in a third embodiment of the present invention.

In the golf club head 1F in FIG. 17, low-rigidity portions L61, L62 extending in an oblique direction relative to the face-back direction are arranged on the toe side of the crown part 5 such that the portions L61, L62 get closer to the toe side as approaching the back side. Also, low-rigidity portions L63, L64 extending in an oblique direction relative to the face-back direction are arranged on the heel side of the crown part 5 such that the portions L63, L64 get closer to the heel side as approaching the back side. Preferably, intersection angle θ between the extension direction of the low-rigidity portions L61-L64 and the face-back direction is 30° or more, particularly 45° or more, and 90° or less, particularly 60° or less. Note that there are two of each low-rigidity portion L61-L64 on the toe side and the heel side in the drawing, but that there may be one or three or more.

Figure 18:
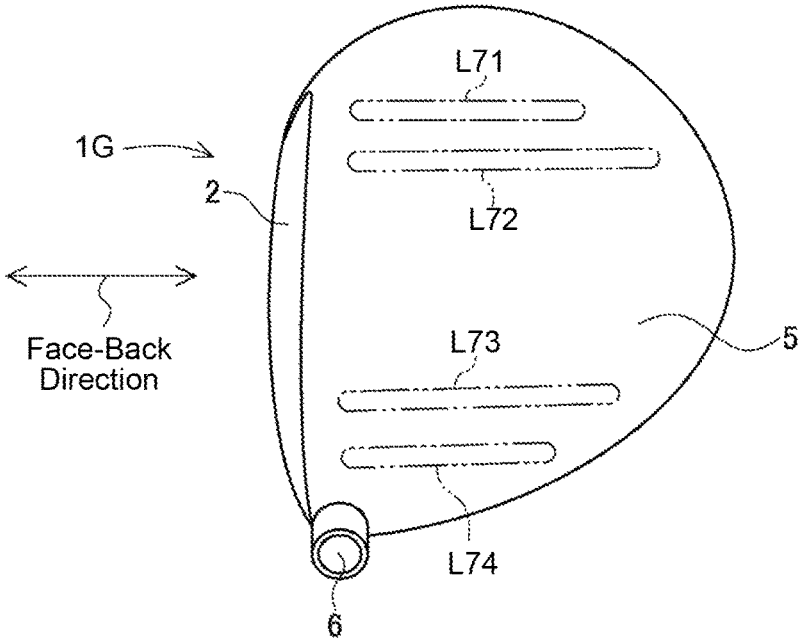
FIG. 18 is a plan view of the golf club head in the third embodiment of the present invention.

In the golf club head 1G in FIG. 18, low-rigidity portions L71-L74 are provided which extend in the face-back direction. Low-rigidity portions L71 and L72 are arranged on the toe side and low-rigidity portions L73 and L74 are arranged on the heel side. Note that there are two of each low-rigidity portion L71-L74 on the toe side and the heel side in the drawing, but that there may be one or three or more.

Figure 19:
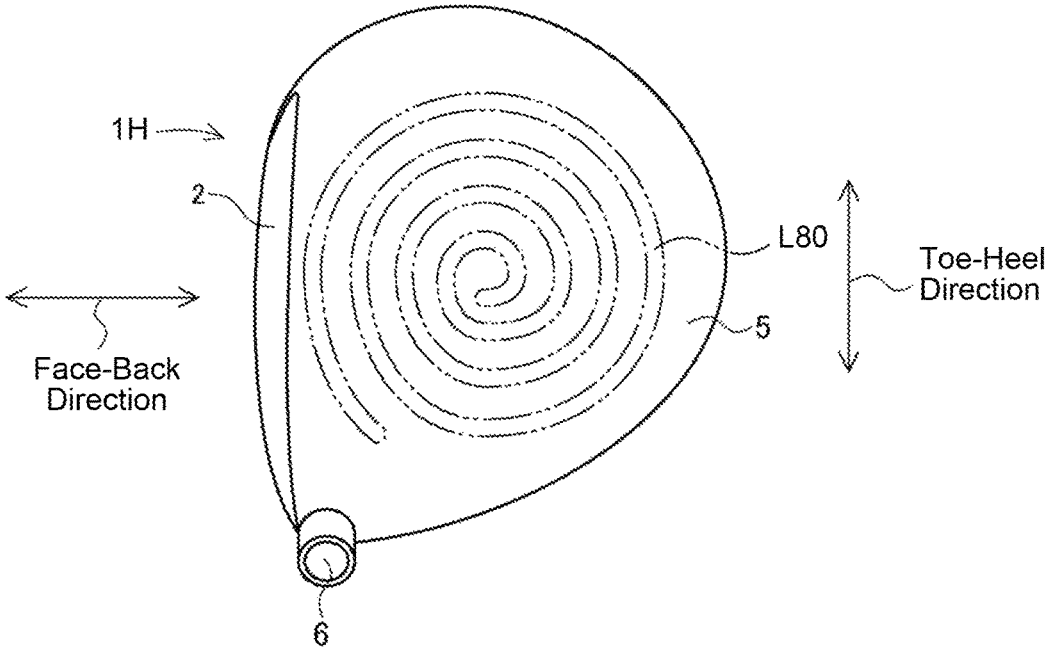
FIG. 19 is a plan view of the golf club head in the third embodiment of the present invention.

In the golf club head 1H in FIG. 19, a spiral-shaped low-rigidity portion L80 is provided. The center of the spiral is near the center of the crown part 5 in the toe-heel direction and in the face-back direction.

Figure 20:
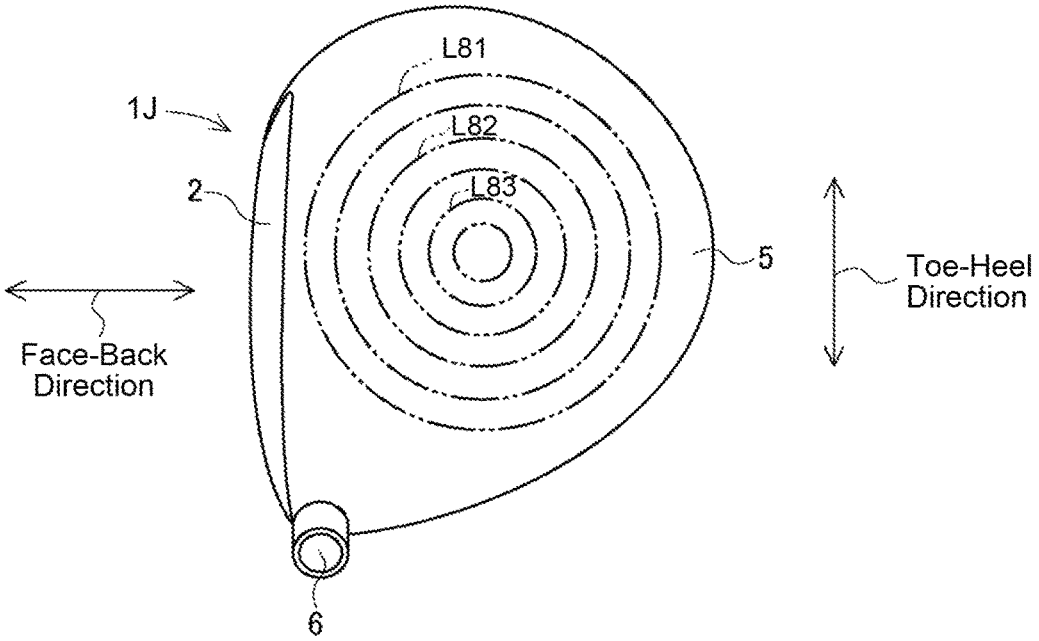
FIG. 20 is a plan view of the golf club head in the third embodiment of the present invention.

In the golf club head 1J in FIG. 20, round, concentric low-rigidity portions L81-L83 are provided. The center of the concentric circles is near the center of the crown part 5 in the toe-heel direction and in the face-back direction. The number of low-rigidity portions L81-L83 may be two or four or more.

The rest of the configuration of the golf club heads 1E-1J is identical to golf club head 1E and identical components are denoted by the same reference numbers.

Figure 21:
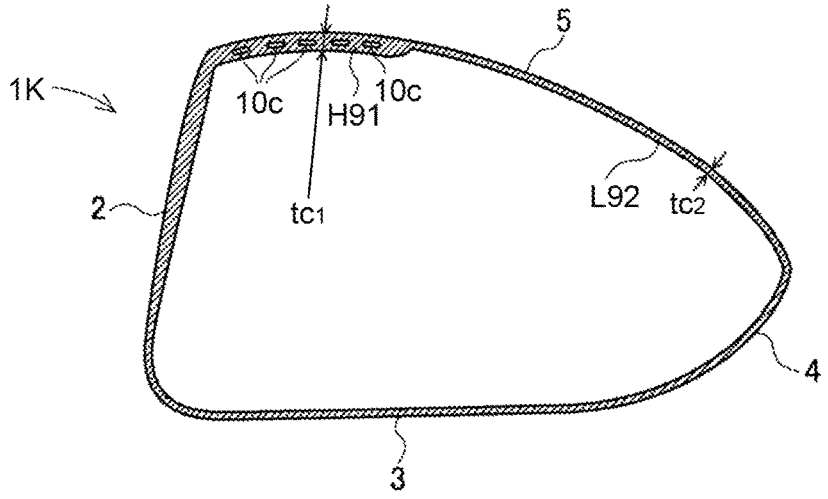
FIG. 21 is a sectional view of the golf club head in a fourth embodiment of the present invention.
Figure 22:
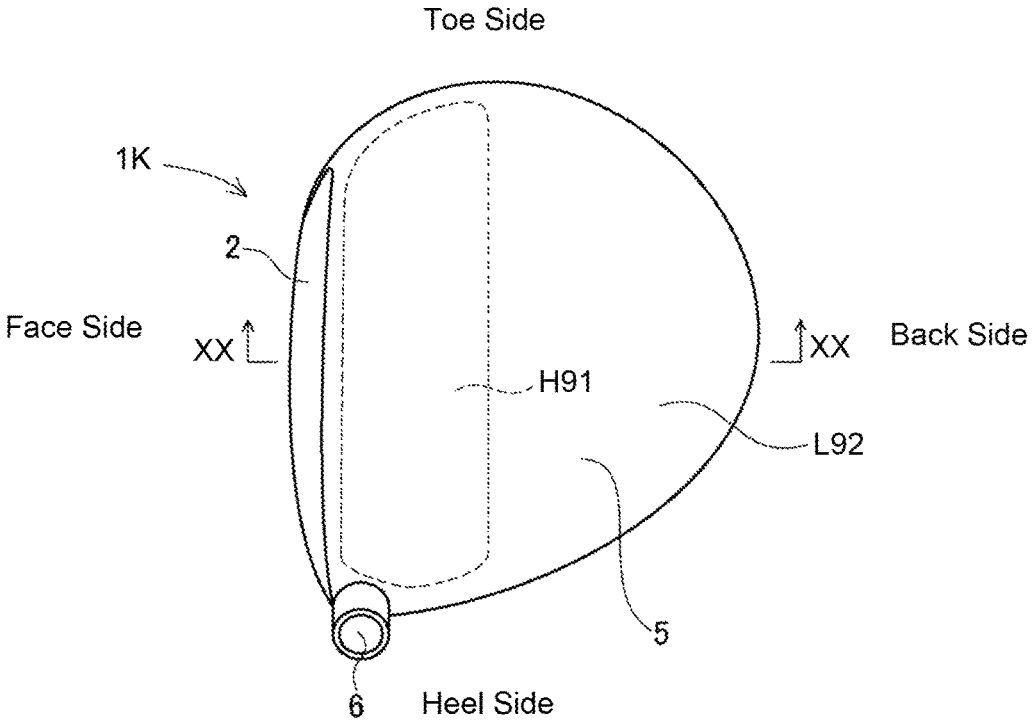
FIG. 22 is a plan view of the golf club head in FIG. 21.

FIG. 21 and FIG. 22 show a golf club head 1K of the second embodiment of the present invention which has a first thickness portion and a second thickness portion. FIG. 21 is a sectional view from XX-XX in FIG. 22.

This golf club head 1K also has a face part 2, a sole part 3, a side part 4, a crown part 5, and a hosel part 6, and the entire head is integrally made of metal.

The crown part 5 has a first thickness portion H91 with a greater thickness $tc_1$ and a second thickness portion L92 with a lesser thickness $tc_2$. In the present embodiment, the first thickness portion H91 occupies the face side of the crown part 5. However, it may also occupy the tow side, heel side, back side, or center of the crown part 5. A plurality of first thickness portions H91 may also be provided.

The first thickness portion H91 is provided so that the hollow chamber parts 10*c* have a substantially uniform distribution. In this way, the rigidity of the first thickness portion H91 and the second thickness portion L92 is substantially equal. The thickness of the second thickness portion L92 is preferably from 60 to 80% of the thickness of the first thickness portion H91.

The golf club head 1K can be designed so that the crown part 5 has the minimum required strength. The minimum required strength of the golf club head 1E, particularly the crown part 5, can be determined using the finite element method (FEM) disclosed in Patent Documents 9 and 10. In other words, FEM analysis can be used to design the head so that the portions subjected to low stress have low rigidity. In this way, the minimum required rigidity can be realized.

For example, in a model of the golf club head 1K without a hollow chamber part, the thickness is determined by FEM analysis and the difference in rigidity between the first thickness portion and the second thickness portion is determined from the shape (curve) of the crown part. The hollow chamber parts 10*c* are then arranged in the first thickness portion H91 with the greater thickness so as to eliminate the difference in rigidity.

When the entire crown part has the same rigidity, the crown part experiences increased deflection. Also, the stress from striking a ball is simulated, and the hollow chamber parts 10*c* are arranged so that the crown part has the minimum required rigidity to withstand this stress.

At the very least, the crown part 5 of the golf club heads 1E-1K can be obtained by press-working a crown plate 5P, 5P'. However, press-working may be omitted.

The crown plate 5P, 5P' (or the crown part 5 when no press working is performed) is preferably manufactured as a single seamless component using the metal powder molding method. In the metal powder molding method, metal powder is exposed to a high-energy beam such as an electron beam or laser beam to sinter the metal powder and create the desired three-dimensional shape.

In the present explanation, the hollow chamber parts 10*c* have a flat disk-like shape. However, the hollow chamber parts are not limited to this shape. A crown plate or a crown part can be molded with any number of hollow chamber parts of any shape or size using the metal powder molding method. Parts other than the crown part can also be molded using the metal powder molding method. When press-working is not performed, the entire golf club head can be molded as an integrated unit using the metal powder molding method. In this way, a golf club head can be molded as a single seamless component.

The molded product obtained in a molding step using the metal powder molding method can then be subjected to heat treatment, surface grinding and polishing, painting, and plating to obtain the final golf club head.

One example of the present invention was explained above, but the present invention can have other configurations.

In the present invention, such as in golf club heads 1E-1K, a plurality of very small hollow chamber parts 10 can be provided to partially reduce the rigidity of the crown part. One or more large hollow chamber parts may also be provided to partially reduce the rigidity of the crown part.

The present invention can also be applied to the head of a fairway wood other than a driver or to the head of a utility club. In the examples of the present invention, 'first thickness t1' was embodied as tf1 and tc1, and 'second thickness t2' was embodied as tf2 and tc2.

What is claimed is:

1. A hollow golf club head, comprising a face part, a sole part, a side part, a crown part, and a hosel part, wherein at least one of the face part and the crown part has portions of two different thicknesses that are first and second thickness portions, the first thickness portion having a first thickness, and the second thickness portion having a second thickness that is different from the first thickness, a rigidity of the first thickness portion is the same as a rigidity of the second thickness portion, the second thickness of the second thickness portion is greater than the first thickness of the first thickness portion, and the second thickness portion has a hollow chamber part that is a hollow chamber entirely enclosed within the second thickness portion.

2. The golf club head according to claim 1, wherein the one of the face part and the crown part having the first and second thickness portions has a uniform rigidity through the entirety thereof.

3. The golf club head according to claim 1, wherein the second thickness portion further includes other hollow chamber parts that are hollow chambers entirely enclosed within the second thickness portion.

4. The golf club head according to claim 1, wherein the crown part is made of a titanium alloy.

5. The golf club head according to claim 1, wherein the one of the face part and the crown part having the first and second thickness portions is press-worked.

6. The golf club head according to claim 1, wherein the second thickness portion is formed using a metal powder molding method.

7. The golf club head according to claim 1, wherein the one of the face part and the crown part having the first and second thickness portions is formed with a single seamless member.

8. The golf club head according to claim 1, wherein the hollow chamber part is formed in the face part, the face part has a uniform rigidity, and a coefficient of restitution is constant over the entire face part.

9. The golf club head according to claim 1, wherein the hollow chamber of the hollow chamber part has a length of 0.5 mm or more and 5 mm or less, the length being determined in a crown to sole direction.

10. The golf club head according to claim 1, wherein the hollow chamber part has a flat disk-like shape.

11. The golf club head according to claim 1, wherein the one of the face part and the crown part having the first and second thickness portions is entirely made of a single material.

12. The golf club head according to claim 1, wherein the crown part has the first and second thickness portions, and the second thickness portion is positioned closer to the face part than the first thickness portion.

* * * * *